US010431083B2

(12) United States Patent
Hamada et al.

(10) Patent No.: US 10,431,083 B2
(45) Date of Patent: Oct. 1, 2019

(54) ONBOARD TERMINAL DEVICE AND TRAFFIC CONTROL SYSTEM

(71) Applicant: HITACHI CONSTRUCTION MACHINERY CO., LTD., Tokyo (JP)

(72) Inventors: Tomoyuki Hamada, Tsuchiura (JP); Hidefumi Ishimoto, Tsukuba (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 221 days.

(21) Appl. No.: 15/509,216

(22) PCT Filed: Jan. 12, 2016

(86) PCT No.: PCT/JP2016/050740

§ 371 (c)(1),
(2) Date: Mar. 7, 2017

(87) PCT Pub. No.: WO2016/143369

PCT Pub. Date: Sep. 15, 2016

(65) Prior Publication Data

US 2017/0278395 A1 Sep. 28, 2017

(30) Foreign Application Priority Data

Mar. 12, 2015 (JP) ..... 2015-049771

(51) Int. Cl.
*G08G 1/00* (2006.01)
*G08G 1/127* (2006.01)
(Continued)

(52) U.S. Cl.
CPC ..... *G08G 1/127* (2013.01); *E21C 47/00* (2013.01); *G08G 1/015* (2013.01); *G08G 1/052* (2013.01);
(Continued)

(58) Field of Classification Search
CPC ..... E21C 47/00; G08G 1/015; G08G 1/052; G08G 1/0962; G08G 1/096775;
(Continued)

(56) References Cited

U.S. PATENT DOCUMENTS 6,038,502 A * 3/2000 Sudo ..... G01S 13/931 180/167
2001/0029425 A1* 10/2001 Myr ..... G01C 21/3492 701/117
(Continued)

FOREIGN PATENT DOCUMENTS

JP 2000-339029 A 12/2000
JP 2003-312475 A 11/2003
(Continued)

OTHER PUBLICATIONS

JP2007323675_-_2007323675-Desc-Espacenet_Translation.pdf.*
(Continued)

*Primary Examiner* — Kira Nguyen
(74) *Attorney, Agent, or Firm* — Mattingly & Malur, PC

(57) ABSTRACT

A terminal side control device that executes processing for instructing travel of a vehicle to a driver on the basis of a travel permission section assigned thereto by a control server. The terminal-side control device includes: a remaining distance calculation unit that calculates a travel permission remaining distance on the basis of the present position of the own vehicle acquired from a position calculation device and the travel permission section; an upper limit speed calculation unit that calculates an upper limit speed of the own vehicle in the travel permission section on the basis of the travel permission remaining distance calculated by the remaining distance calculation unit; and a display control unit that causes a terminal side display device to output and present to the driver the upper limit speed calculated by the
(Continued)

upper limit speed calculation unit and predetermined warning information corresponding to the upper limit speed.

7 Claims, 13 Drawing Sheets

(51) Int. Cl.

| | |
|---|---|
| ***G08G 1/0962*** | (2006.01) |
| ***G08G 1/16*** | (2006.01) |
| ***G08G 1/015*** | (2006.01) |
| ***G08G 1/052*** | (2006.01) |
| ***E21C 47/00*** | (2006.01) |
| ***G08G 1/0967*** | (2006.01) |

(52) U.S. Cl.
CPC ..... *G08G 1/0962* (2013.01); *G08G 1/096775* (2013.01); *G08G 1/16* (2013.01); *G08G 1/164* (2013.01); *G08G 1/207* (2013.01)

(58) Field of Classification Search
CPC ..... G08G 1/127; G08G 1/16; G08G 1/164; G08G 1/207
See application file for complete search history.

(56) References Cited

U.S. PATENT DOCUMENTS

2015/0066350 A1* 3/2015 Iwata ..... G01C 21/3469 701/400
2015/0109756 A1* 4/2015 Choi ..... B60K 37/02 362/23.01

FOREIGN PATENT DOCUMENTS

| | | | | |
|---|---|---|---|---|
| JP | 2007-159309 | A | | 6/2007 |
| JP | 2007323675 | A | * | 8/2007 |
| JP | 2007-323675 | A | | 12/2007 |
| JP | 2008-137652 | A | | 6/2008 |
| JP | 2009-55694 | A | | 3/2009 |

OTHER PUBLICATIONS

JP2003312475_-_Description_-_Espacenet_Translation.pdf.*
582607--15509216--EIC3600_Search_Report.pdf.*
International Search Report of PCT/JP2016/050740 dated Apr. 5, 2016.

* cited by examiner

FIG. 4A

400

| NODE ID (401) | NODE COORDINATE (402) |
|---|---|
| $N_{n-1}$ | $x_{n-1}, y_{n-1}$ |
| $N_n$ | $x_n, y_n$ |
| $N_{n+1}$ | $x_{n+1}, y_{n+1}$ |
| $N_{n+2}$ | $x_{n+2}, y_{n+2}$ |
| $N_{n+3}$ | $x_{n+3}, y_{n+3}$ |

FIG. 4B

420

| LINK ID (421) | FORWARD NODE ID (422) | BACKWARD NODE ID (423) | SPEED LIMIT (424) | CURVATURE (425) |
|---|---|---|---|---|
| $L_{n-1}$ | $N_{n-1}$ | $N_n$ | $v_{n-1}$ | $c_{n-1}$ |
| $L_n$ | $N_n$ | $N_{n+1}$ | $v_n$ | $c_n$ |
| $L_{n+1}$ | $N_{n+1}$ | $N_{n+2}$ | $v_{n+1}$ | $c_{n+1}$ |
| $L_{n+2}$ | $N_{n+2}$ | $N_{n+3}$ | $v_{n+2}$ | $c_{n+2}$ |
| $L_{n+3}$ | $N_{n+3}$ | $N_{n+4}$ | $v_{n+3}$ | $c_{n+3}$ |

| 501 VEHICLE ID | 502 FORWARD BOUNDARY POINT | 503 BACKWARD BOUNDARY POINT | 504 DESTI-NATION | 505 TRAVEL SPEED | 506 TRAVEL DIREC-TION | 507 PRESENT POSITION |
|---|---|---|---|---|---|---|
| $D_1$ | $N_{n-2}$ | $N_n$ | $P_1$ | $VD_1$ | F | $N_{n-1}$ |
| $D_2$ | $N_n$ | $N_{n+2}$ | $P_2$ | $VD_2$ | R | $N_{n+1}$ |
| $D_3$ | $N_{n+2}$ | $N_{n+4}$ | $P_3$ | $VD_3$ | F | $N_{n+3}$ |

ONBOARD TERMINAL DEVICE AND TRAFFIC CONTROL SYSTEM

TECHNICAL FIELD

The present invention relates to an onboard terminal device and a traffic control system, and relates specifically to a technology of control for preventing interference between vehicles traveling in a mine.

BACKGROUND ART

In an open pit mine and the like, when an unmanned vehicle such as a dump truck transporting excavated ore is made to autonomously travel, it is necessary to control manned vehicles such as a dozer and grader for maintaining a road, a motor sprinkler for preventing dust, a service car for a patrol, and so on and unmanned vehicles so as not to interfere with each other.

As one of prior arts for such purpose, a vehicle monitoring system is known, for example, which is configured of plural vehicles each provided with a vehicle position measuring device that measures the own vehicle position and a monitoring station that receives position data transmitted from each of these plural vehicles and transmits instruction data for instructing these plural vehicles of travel, stop and the like while monitoring the mutual positional relation of these plural vehicles based on the position data received (refer to Patent Literature 1).

SUMMARY OF INVENTION

Technical Problem

According to the prior art disclosed in Patent Literature 1 described above, it is configured that the monitoring station constantly grasps the positional relation of each vehicle and conducts preset control so as to avoid interference of vehicles according to the positional relation of them. However, while a trouble occurs in the communication condition such that communication between each vehicle and the monitoring station is interrupted and so on, the monitoring station cannot recognize the mutual positional relation of respective vehicles, and it becomes difficult to conduct proper control. Accordingly, even when the possibility of interference of the vehicles is actually low, the monitoring station needs such action of stopping each vehicle and so on considering the safety of the work, and therefore drop of the work efficiency owing to the trouble of the communication condition has become a problem.

The present invention has been achieved in the circumstances of such prior art, and its object is to provide an onboard terminal device and a traffic control system that can suppress interference between vehicles and can improve the work efficiency even when a problem occurs in the communication condition.

Solution To Problem

In order to achieve the object described above, the present invention is an onboard terminal device that is connected to a traffic control server through a radio communication channel, the traffic control server conducting traffic control for avoiding interference between vehicles including an unmanned vehicle that travels autonomously in a mine, and is mounted on a manned vehicle that travels with a driver getting on including a travel instruction processing device that conducts processing for instructing the driver on travel of an own vehicle that is the manned vehicle with the driver getting on based on a travel permission section where a partial section of a travel route of the vehicle is assigned by the traffic control server as a section permitted for the vehicle to travel in which the travel instruction processing device includes a remaining distance calculation unit that calculates a travel permission remaining distance that shows a distance between a present position of the own vehicle to an end of the travel permission section along the travel route on the basis of the present position of the own vehicle acquired from a position acquiring device that is connected to the travel instruction processing device and the travel permission section, an upper limit speed calculation unit that calculates an upper limit speed of the own vehicle in the travel permission section on the basis of the travel permission remaining distance calculated by the remaining distance calculation unit, and an information presentation unit that causes an output device connected to the travel instruction processing device to output and present to the driver the upper limit speed calculated by the upper limit speed calculation unit and predetermined warning information corresponding to the upper limit speed.

Advantageous Effects Of Invention

According to the onboard terminal device and the traffic control system of the present invention, even when a problem occurs in the communication condition, interference of vehicles can be suppressed, and the working efficiency can be improved. Problems, configurations and effects other than the above will be clarified by explanation of embodiments below.

BRIEF DESCRIPTION OF DRAWINGS

FIG. 4 is a drawing showing a configuration of map information stored in a master map information DB shown in FIG. 3, FIG. 4A is a drawing showing a configuration of node information, and FIG. 4B is a drawing showing a configuration of link information.

FIG. 8 is a drawing explaining a setting process for a travel permission section by a travel permission section setting unit shown in FIG. 7.

FIG. 11 is a drawing explaining a configuration of a display screen of a terminal side display device shown in FIG. 9.

DESCRIPTION OF EMBODIMENTS

Figure 1:
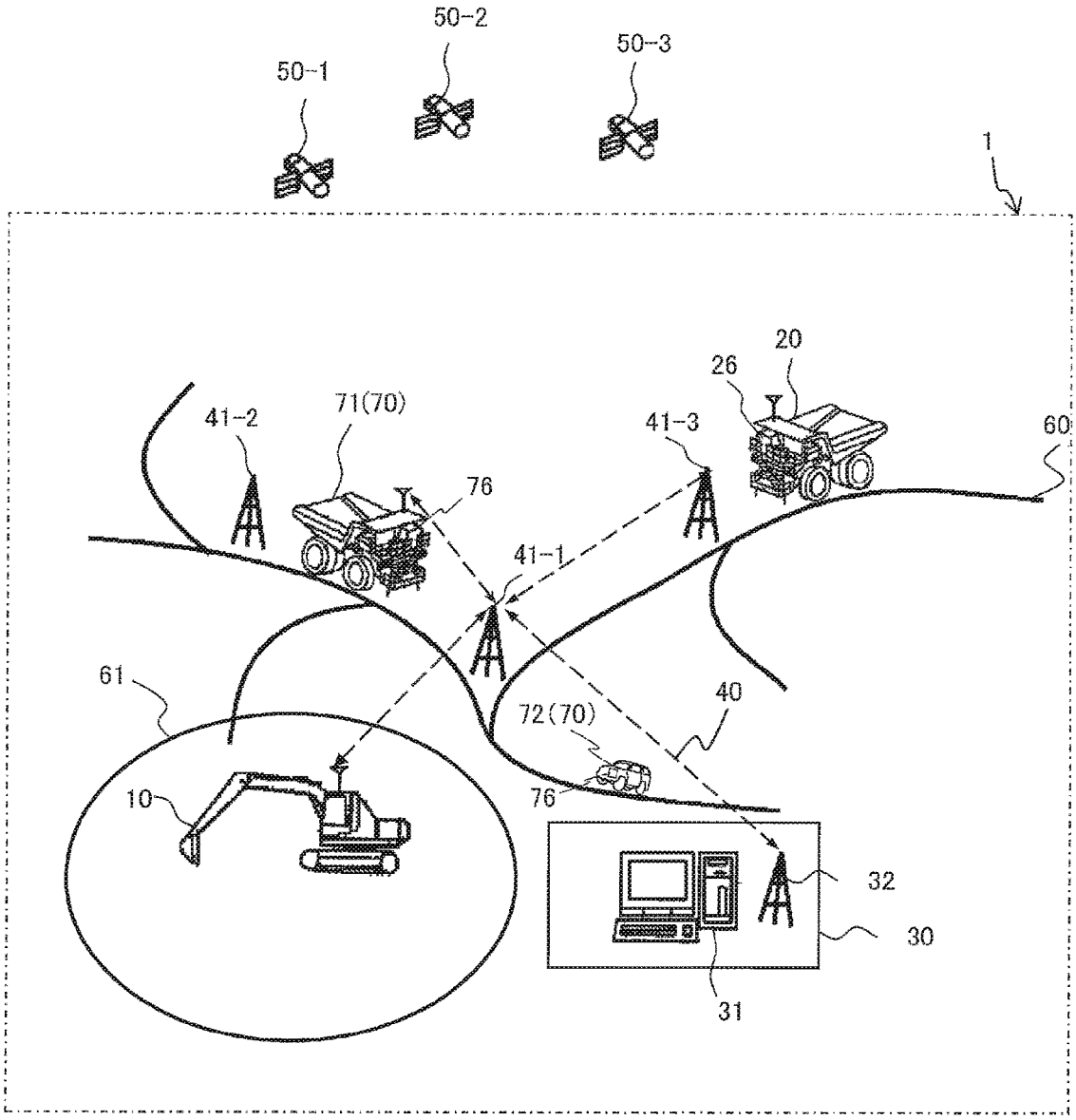
FIG. 1 is a drawing showing a schematic configuration of a traffic control system related to a first embodiment of the present invention.

Below, embodiments of an onboard terminal device and a traffic control system related to the present invention will be explained based on the drawings.

Below, the embodiments of the present invention will be explained in detail based on the drawings. Also, in all drawings for explaining the embodiments, a member having a same function will be marked with a same or related reference sign, and repeated explanation thereof will be omitted. Further, in the embodiments below, explanation of a same or similar portion will not be basically repeated unless particularly necessary.

First Embodiment

A first embodiment of the present invention relates to a traffic control system that connects a dump truck (corresponding to an unmanned vehicle), a manned vehicle (inclusive of a case a driver gets on an unmanned vehicle), and a traffic control server (will be hereinafter abbreviated as "control server" for convenience) by a radio communication channel, the dump truck transporting soil, ore, and the like loaded by a loading machine such as a shovel and wheel loader in amine and traveling autonomously without a driver getting on, the manned vehicle being such as a dozer, grader, motor sprinkler, and a service car traveling with a driver getting on, the traffic control server conducting traffic control for avoiding interference of these dump truck and manned vehicle, and is featured particularly in providing an instruction to a driver getting on a manned vehicle on travel of the own vehicle that is the manned vehicle with the driver oneself getting on. Below, a traffic control system related to the first embodiment of the present invention will be explained referring to the drawings.

First, a schematic configuration of a traffic control system related to the first embodiment of the present invention will be explained in detail referring to FIG. 1.

As shown in FIG. 1, a traffic control system 1 related to the first embodiment of the present invention is configured by mutual communication connection with respect to a shovel 10, a dump truck 20 (corresponding to an unmanned vehicle), a manned vehicle 70, and a control server 31 through a radio communication channel 40, the shovel 10 conducting loading work of soil, ore, and the like at a loading station 61 as a working station including a quarry and a loading station of a mine and the like, the dump truck 20 being an autonomous travel vehicle for transporting a load of the soil, ore, and the like loaded by the shovel 10, the manned vehicle 70 being a dump truck 71, a dozer (not illustrated), a motor sprinkler (not illustrated), a service car 72, and the like, the dump truck 71 being similar to the dump truck 20 but another vehicle a driver gets on, the control server 31 being installed in a control center 30 located in the vicinity of or remote from the quarry.

The dump truck 20 reciprocates between the loading station 61 and soil dumping stations 62, 63 (refer to FIG. 2) along a transportation road 60 that is preset within the mine, and transports a load.

Plural radio base stations 41-1, 41-2, 41-3 are installed within the mine. Also, a radio wave of radio communication is transmitted and received through these radio base stations 41-1, 41-2, 41-3.

The shovel 10, the dump truck 20, and the manned vehicle 70 include a position calculation device (illustration thereof is omitted in FIG. 1) such as a GPS (Global Positioning System) for receiving a positioning radio wave from at least 3 navigation satellites 50-1, 50-2, 50-3 and calculating the position of the own vehicle. In other words, these navigation satellites 50-1, 50-2, 50-3 and the position calculation device function as a position acquiring device acquiring the present position of the vehicle. In fact, the dump truck 20 and the manned vehicle 70 are present by a plurality, and each of them communicates with the control server 31 wirelessly.

The dump truck 20 mounts an onboard terminal device (will be hereinafter abbreviated as "dump terminal device" for convenience) 26 for conducting autonomous travel according to an instruction from the control server 31.

The manned vehicle 70 mounts an onboard terminal device (will be hereinafter abbreviated as "manned vehicle terminal device" for convenience) 76 for receiving an instruction from the control server 31 so as not to interfere with the other vehicle 20 and giving an instruction on travel of the own vehicle to the driver. Further, the manned vehicle terminal device 76 may be mounted also on the shovel 10 although illustration thereof is omitted.

The control server 31 is connected to an antenna 32 that is for connection with the radio communication channel 40. Also, the control server 31 communicates with each of the dump terminal device 26 and the manned vehicle terminal device 76 through the antenna 32 and the radio base stations 41-1, 41-2, 41-3.

Figure 2:
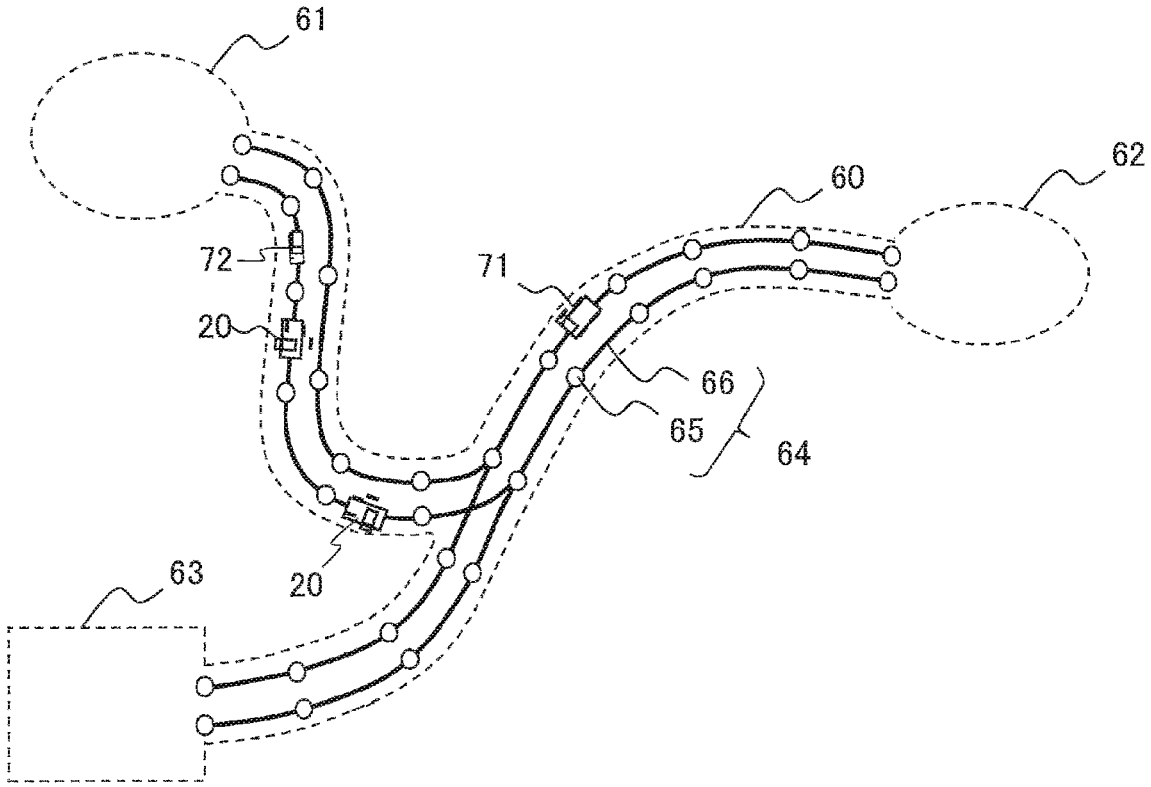
FIG. 2 is a drawing showing the detail of a transportation road shown in FIG. 1.

FIG. 2 is a drawing showing the detail of the transportation road 60 of FIG. 1, and shows a configuration example of an open pit mine site where the dump truck 20 and the manned vehicle 70 travel. The transportation road 60 connects the loading station 61 with the soil dumping station 62 and the soil dumping station 63. The dump truck 20 loads surface soil, ore and the like at the loading station 61, travels along the transportation road 60, and transports the surface soil, ore and the like to the soil dumping station 62 and the soil dumping station 63.

The loading station 61 is a work station for loading the surface soil, ore and the like excavated by the shovel 10 to the dump truck 20.

The soil dumping station 62 is a work station where the surface soil and the like transported from the excavation site by the dump truck 20 are dumped and are spread in a layered form or a radial form.

The soil dumping station 63 is a work station where a crusher (not illustrated) and the like for crushing the ore are installed. The ore crushed by the crusher is transported by a belt conveyor and the like to a load out site by a railroad freight car or a processing facility and the like.

In each of the work stations described above, an operator gets on a dozer and displaces spilt soil to a position not impeding travel of the dump truck 20, gets on a measuring car that measures positional information, travels within the work station, and measures the positional information, and so on.

On the transportation road 60, two travel routes 64 with different travel direction of the dump truck 20 are arranged. Respective travel routes 64 constitute an inbound traffic lane and an outbound traffic lane. Respective travel routes 64 connect the entrance or exit of respective work stations to each other. The travel route of each work station is formed from time to time according to movement of the vehicle stop position of the dump truck 20 within the work station, for example, movement of the loading point and movement of the soil dumping point.

The travel route 64 is given as coordinate values set on a map. The dump truck 20 travels in an unmanned state along the travel route 64 by controlling acceleration and deceleration as well as steering while comparing the own position determined by the position sensor (GPS) and the coordinate values of the travel route 64. With respect to information of the travel route 64 and nodes 65, same information is stored as the map data of the control server 31 and the map data of the dump truck 20. The control server 31 controls travel so as to avoid interference of the dump trucks 20 to each other by granting/cancelling the travel permission for each travel section that is specified to be a portion between the nodes 65 and notifying the dump truck 20 of the information. The portion between neighboring nodes 65 is called a link 66.

Next, a hardware configuration of the control server 31 and a configuration of the dump truck 20 including a hardware configuration of the dump terminal device 26 related to the first embodiment of the present invention will be explained in detail referring to FIG. 3.

Figure 3:
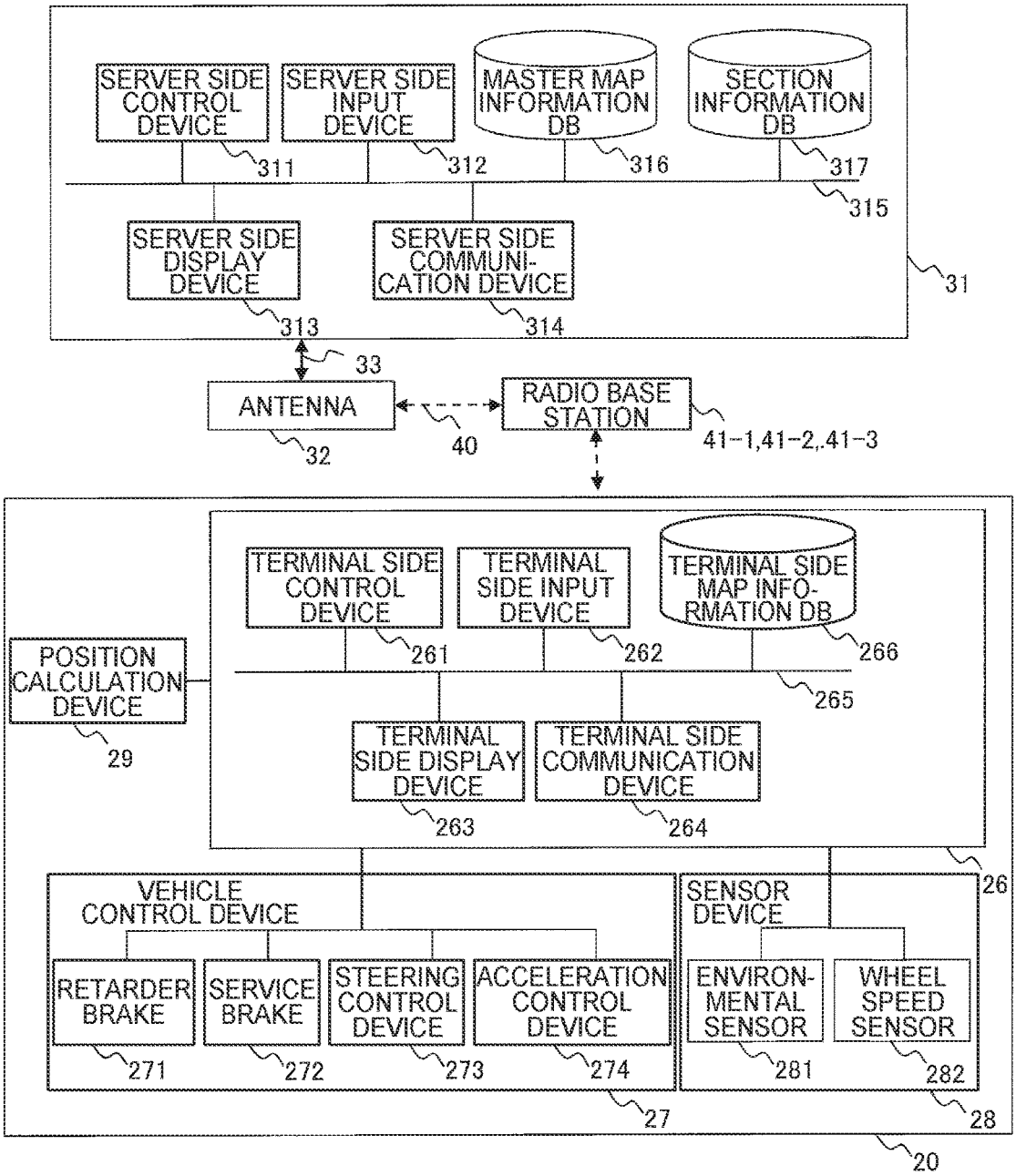
FIG. 3 is a drawing showing a hardware configuration of a control server and a configuration of a dump truck including a hardware configuration of a dump terminal device related to the first embodiment of the present invention.

As shown in FIG. 3, the control server 31 is configured so as to include a server side control device 311, a server side input device 312, a server side display device 313, a server side communication device 314, a communication bus 315, a master map information database (database will be hereinafter abbreviated as "DB" for convenience) 316, and a travel permission section information DB (will be hereinafter abbreviated as "section information DB" for convenience) 317.

The server side control device 311 is for controlling the motion of each constituent element of the control server 31, and is configured using a calculation/control device such as a CPU (Central Processing Unit), a storage device such as a ROM (Read Only Memory) and an HDD (Hard Disk Drive) which stores programs executed by the control server 31, and hardware including a RAM (Random Access Memory) which becomes a work region when the CPU executes the programs. The function configuration of the programs executed in the control server 31 will be described below referring to FIG. 7. Further, the server side control device 311 may be configured also using an integrated circuit (ASIC: application specific integrated circuit) for achieving functions executed by the control server 31.

The server side input device 312 is configured by an input device such as a mouse, keyboard and the like, and functions as a user interface when an operator executes an operation for inputting information required, for example, for controlling autonomous travel of the dump truck 20 and instructing travel of the manned vehicle 70.

The server side display device 313 is configured by a liquid crystal monitor and the like, and functions as an interface that displays and provides information to the operator.

The server side communication device 314 is configured by a device for connecting communication to a wire communication channel 33 and the radio communication channel 40. The server side communication device 314 receives section demand information described below from the dump truck 20 and the manned vehicle 70, and transmits section response information and non-permission response information described below to the dump truck 20 and the manned vehicle 70.

The communication bus 315 electrically connects respective constituent elements to each other.

The master map information DB 316 is configured using a storage device such as an HDD that fixedly stores information, and stores the map information that is defined by the position information (coordinate value) of each node 65 on the transportation road 60 and the link 66 connecting respective nodes 65. Further, the master map information DB 316 may also include topographic information of the mine, and an absolute coordinate (three-dimensional actual coordinate calculated on the basis of the positioning radio wave) of each node 65. To each of the nodes 65 and the links 66, position identification information (will be hereinafter referred to as "node ID" and "link ID" for convenience) that identifies the node 65 and the link 66 uniquely is given.

The map information includes node information 400 that correlates a node ID 401 and a node coordinate 402 as shown in FIG. 4A, for example, and link information 420 that correlates a link ID 421 and attribute information of the link such as a node (forward node ID) 422 at the front end of the link, a node (backward node ID) 423 at the rear end, a speed limit 424, a curvature 425 of the transportation road 60, and the like as shown in FIG. 4B. Further, the map information may also include the direction of the dump truck 20 traveling on the travel route 64.

Figures 5, 6:
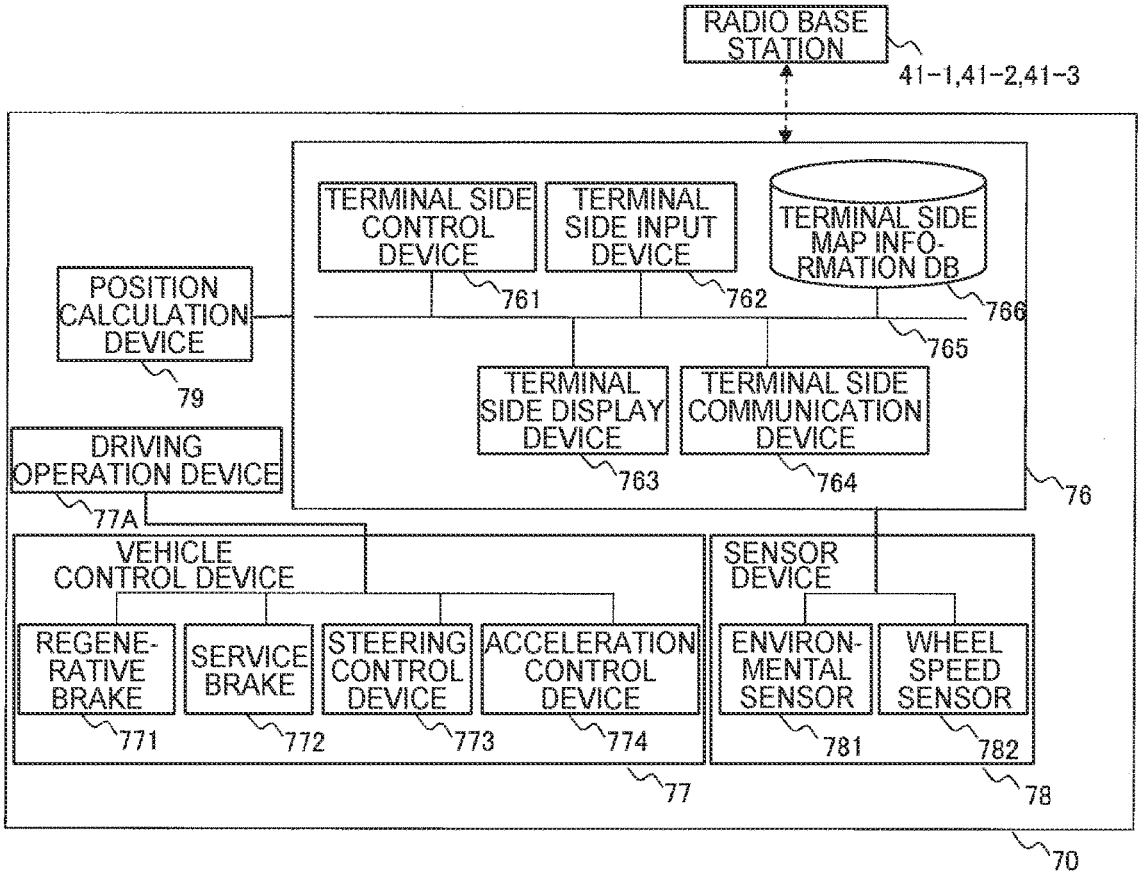
FIG. 5 is a drawing showing a configuration of section information stored in a section information DB shown in FIG. 3.
FIG. 6 is a drawing showing a configuration of a manned vehicle including a hardware configuration of a manned vehicle terminal device related to the first embodiment of the present invention.

The section information DB 317 is configured using a storage device such as an HDD that fixedly stores information, and stores the present position of the dump truck 20 and the manned vehicle 70 and the section information including the travel permission section assigned to the dump truck 20 and the manned vehicle 70. As shown in FIG. 5, for example, this section information is configured so as to correlate a vehicle ID 501 identifying each vehicle uniquely to a forward boundary point (shown by a node ID, same with respect to the backward boundary point also) 502 of a travel permission section set for the vehicle, a backward boundary point 503, a destination 504 showing the final destination coordinate set for each vehicle at present, an actual travel speed 505 of the vehicle, a travel direction 506 showing whether the vehicle is traveling forward or rearward, and a present position 507 of the vehicle notified from each vehicle regularly or as needed.

Each of the master map information DB 316 and the section information DB 317 having such configuration may include only a storage unit storing the map information and the section information and the server side control device 311 may execute updating/retrieving process of the DB, or otherwise an engine executing updating/retrieving process of the information may be mounted on each DB.

In contrast, the dump truck 20 is an electrically driven dump truck, and includes a vehicle control device 27 that receives an instruction from the dump terminal device 26 and controls acceleration and deceleration as well as steering, a sensor device 28, and a position calculation device 29 in addition to the dump terminal device 26 as shown in FIG. 3.

The dump terminal device 26 is configured so as to include a terminal side control device 261, a terminal side input device 262, a terminal side display device 263, a terminal side communication device 264, a communication bus 265, and a terminal side map information DB 266.

Since each of the terminal side control device 261, the terminal side input device 262, the terminal side display device 263, the terminal side communication device 264, the communication bus 265, and the terminal side map information DB 266 has a same configuration to that of each of the server side control device 311, the server side input device 312, the server side display device 313, the server side communication device 314, the communication bus 315, and the master map information DB 316, duplicated explanation thereof will be omitted. The terminal side map information DB 266 described above stores map information same to that stored in the master map information DB 316.

The vehicle control device 27 includes a regenerative brake 271, a mechanical brake 272, a steering control device 273, and an acceleration control device 274. The vehicle control device 27 is electrically connected to the dump terminal device 26, and makes the dump truck 20 autonomously travel according to an instruction from the control server 31.

The sensor device 28 includes an environmental sensor 281 such as a millimeter wave radar, a front camera, and the like, for example, for detecting an obstacle at a forward position in the travel direction (advancing direction) of the dump truck 20 and a wheel speed sensor 282 that is arranged in the vicinity of a front wheel of the dump truck 20 and detects the rotation speed of the front wheel. Since the wheel speed sensor 282 detects the rotation speed of a driven wheel of the dump truck 20, the wheel speed sensor 282 can be deemed to detect the speed of the vehicle.

The position calculation device 29 calculates the present position of the own vehicle on the basis of the positioning radio wave from the navigation satellites 50-1, 50-2, 50-3 (refer to FIG. 1). The present position of the own vehicle calculated is transmitted from the dump terminal device 26 to the control server 31.

Next, a configuration of the manned vehicle 70 including a hardware configuration of the manned vehicle terminal device 76 related to the first embodiment of the present invention will be explained in detail referring to FIG. 6.

Similarly to the dump truck 20, the manned vehicle 70 includes a vehicle control device 77 that controls acceleration and deceleration as well as steering by operation of a driver, a sensor device 78, and a position calculation device 79 in addition to the manned vehicle terminal device 76 as shown in FIG. 6.

Similarly to the dump terminal device 26, the manned vehicle terminal device 76 also includes a terminal side control device 761, a terminal side input device 762, a terminal side display device (output device) 763, a terminal side communication device 764, a communication bus 765, and a terminal side map information DB 766. Since these respective constituent elements have a configuration similar to that of the dump terminal device 26, duplicated explanation thereof will be omitted.

The vehicle control device 77 includes a regenerative brake 771, a mechanical brake 772, a steering control device 773, and an acceleration control device 774. The vehicle control device 77 is electrically connected to a driving operation device 77A such as an acceleration pedal accelerating the manned vehicle 70 and a deceleration pedal decelerating the manned vehicle 70, and makes the own vehicle travel through the vehicle control device 77 by that the driver operates the driving operation device 77A while properly confirming the display screen of the terminal side display device 763.

The sensor device 78 includes an environmental sensor 781 and a wheel speed sensor 782. Since each constituent element of the sensor device 78 and the position calculation device 79 is similar to that of the dump truck 20, duplicated explanation thereof will be omitted.

Next, a concrete configuration showing the function of the control server 31 and the dump terminal device 26 related to the first embodiment of the present invention will be explained in detail referring to FIG. 7 and FIG. 8.

Figure 7:
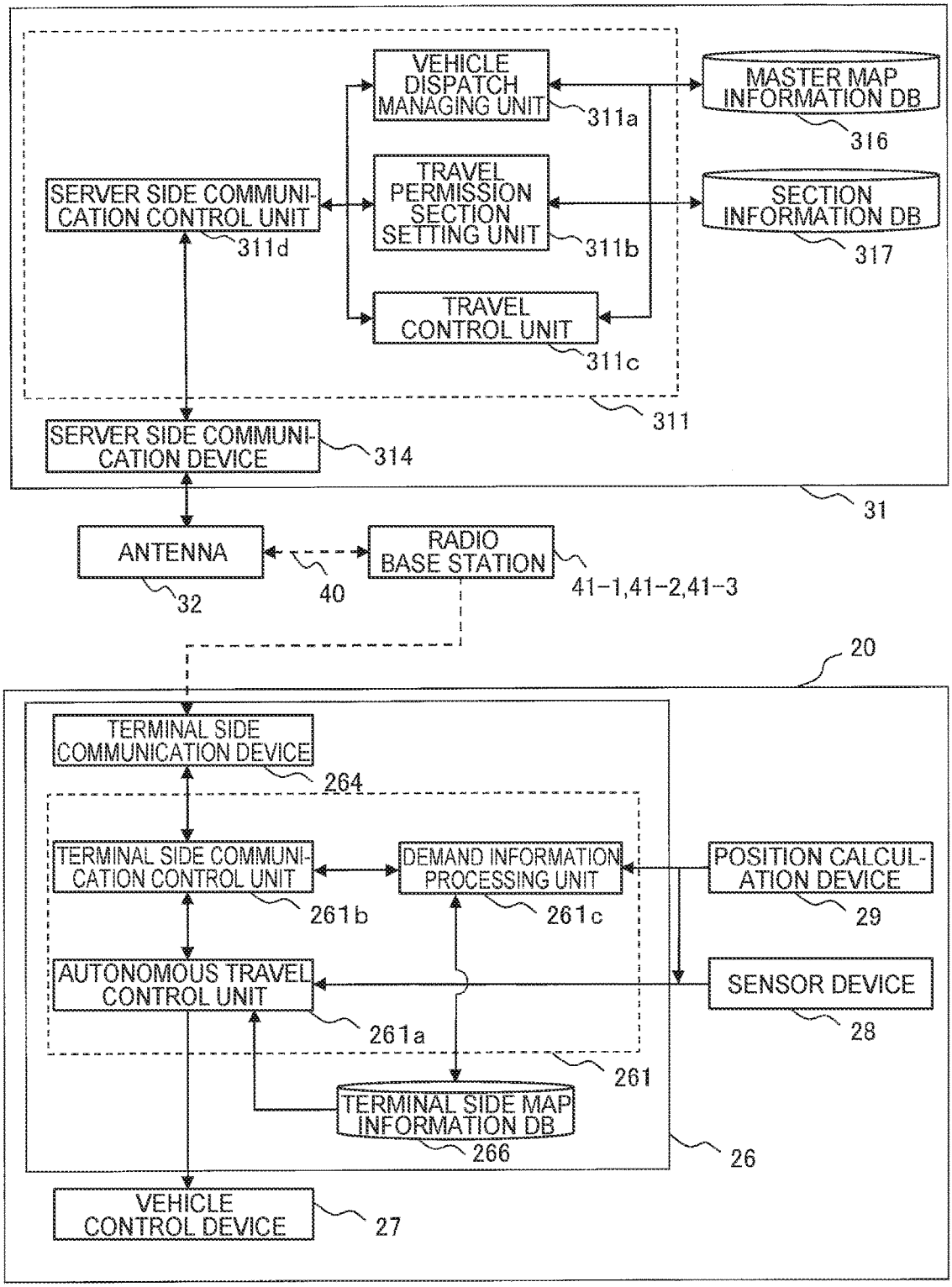
FIG. 7 is a function block diagram showing main functions of a control server and a dump terminal device shown in FIG. 3.

As shown in FIG. 7, the server side control device 311 of the control server 31 includes a vehicle dispatch managing unit 311*a*, a travel permission section setting unit 311*b*, a travel control unit 311*c*, and a server side communication control unit 311*d*.

The vehicle dispatch managing unit 311*a* sets a destination of the dump truck 20 and the manned vehicle 70, refers to the map information stored in the master map information DB 316, and determines the travel route 64 from the present position to the destination.

The travel permission section setting unit 311*b* refers to the map information stored in the master map information DB 316 with respect to the dump truck 20 and the manned vehicle 70, sets a partial section of the travel route 64 on the transportation road 60 as a travel permission section for allowing the dump truck 20 to travel, and creates section information that shows the position of the travel permission section.

The travel permission section setting unit 311*b* overwrites and updates the section information stored in the section information DB 317 with newly created section information. As described above, the section information includes a node ID of the forward boundary point 502 which is a node of the foremost end of the travel permission section and a node ID of the backward boundary point 503 which is a node of the rearmost end. Since the section information includes the travel permission section set for the dump truck 20 and the manned vehicle 70, when the section information is referred to, in which travel permission section the dump truck 20 and the manned vehicle 70 exist and, by referring to the map information, the travel direction of the dump truck 20 and the manned vehicle 70 are grasped.

When information demanding setting of new travel permission section (will be hereinafter referred to as "section demand information" for convenience) from the dump terminal device 26, the travel permission section setting unit 311*b* executes a setting process for the travel permission section responding to it. When a new travel permission section setting has been set, the travel permission section setting unit 311*b* creates section response information that shows the new travel permission section. When the section response information could not be created, the travel permission section setting unit 311*b* creates non-permission response information that shows non-permission of travel.

The travel control unit 311*c* creates control information that shows the travel speed of the dump truck 20 and the manned vehicle 70, and travel or start permission, display stop, oil feed timing, and the like of the dump truck 20 and the manned vehicle 70.

The server side communication control unit 311*d* executes control of radio communication between the dump terminal device 26 and the manned vehicle terminal device 76. The server side communication control unit 311*d* executes control for transmitting and receiving the section demand information, the section response information, the non-permission response information, and the control information between the dump terminal device 26 and the manned vehicle terminal device 76.

Next, the dump terminal device 26 will be explained. The terminal side control device 261 of the dump terminal device 26 includes an autonomous travel control unit 261*a*, a terminal side communication control unit 261*b*, and a demand information processing unit 261*c*.

The autonomous travel control unit 261*a* executes control for acquiring the present position of the own vehicle from the position calculation device 29, referring to the map information of the terminal side map information DB 266, and making the own vehicle travel according to the travel permission section included in the section information with respect to the vehicle control device 27. Also, the autonomous travel control unit 261*a* determines presence/absence of a forward obstacle on the basis of the detection result of the sensor device 28, also determines presence/absence of the avoiding motion for interference and collision against the obstacle, and, if necessary, executes control for a braking motion.

The terminal side communication control unit 261*b* executes control of radio communication conducted between the control server 31. The terminal side communication control unit 261*b* transmits the section demand information, and receives the section response information, the non-permission response information, and the control information.

The demand information processing unit 261*c* determines whether the dump truck 20 has reached a point for transmitting the section demand information on the basis of the map information stored in the terminal side map information DB 266 and the present position calculated by the position calculation device 29. When the dump truck 20 reaches the demand point, the demand information processing unit 261*c* creates section demand information, and transmits the section demand information to the control server 31 through the terminal side communication control unit 261*b*.

The vehicle dispatch managing unit 311*a*, the travel permission section setting unit 311*b*, the travel control unit 311*c*, and the server side communication control unit 311*d* in the control server 31 configured as described above are achieved by that the programs achieving the function of them are executed by the server side control device 311 (hardware) shown in FIG. 3.

In a similar manner, the autonomous travel control unit 261*a*, the terminal side communication control unit 261*b*, and the demand information processing unit 261*c* in the dump terminal device 26 configured as described above are achieved by that the programs achieving the function of them are executed by that the programs achieving the function of them are executed by the terminal side control device 261 (hardware) shown in FIG. 3.

Here, the setting process for the travel permission section by the travel permission section setting unit 311*b* in the control server 31 will be explained in detail referring to FIG. 8.

Figure 8A:
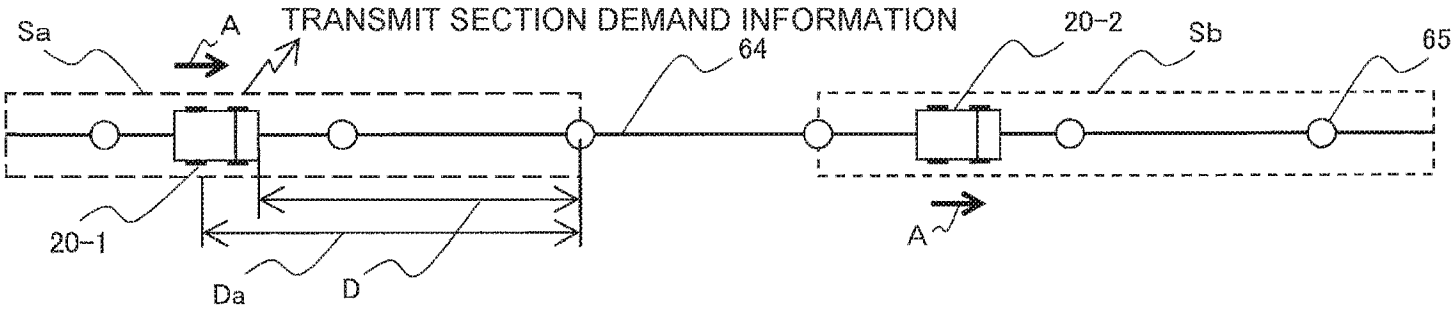
FIG. 8A is a drawing showing a travel permission section set for each dump truck.

Dump trucks 20-1, 20-2 shown in FIG. 8A are dump trucks during traveling toward the arrow A direction. A section Sa is a travel permission section that is set for the dump truck 20-1. A section Sb is a travel permission section that is set for the dump truck 20-2. A distance D is a travel permission remaining distance showing the distance along the travel route 64 from the present position of the dump truck 20 to the forward boundary point (distal end) of the travel permission section Sa. A distance Da is a travel permission demand start distance for starting transmission of the section demand information. In explanation below, when the trucks 20-1 and 20-2 are not discriminated, the dump truck is written as the dump truck 20.

The travel permission demand start distance Da is a distance longer than a distance the dump truck 20 can stop (will be hereinafter referred to as "stoppable distance", and will be expressed as UVSL), and is defined, for example, as a distance adding a predetermined offset distance m to UVSL. In this case, the travel permission demand start distance Da can be expressed by an expression (1) below. Also, UVSL is calculated on the basis of a distance the dump truck 20 can stop from the present speed, and can be expressed by an expression (2) below, for example.

[Math. 1]

$$Da=UVSL+m \tag{1}$$

where m: margin

[Math. 2]

$$UVSL=c_u\frac{M_u v_u^2}{2f_u} \tag{2}$$

where $c_u$: factor determined for obtaining stoppable distance of unmanned dump truck $M_u$: mass including load of unmanned dump truck $V_u$: present speed of unmanned dump truck $f_u$: braking force of unmanned dump truck The value of the predetermined offset distance m is set considering the time taken for radio communication, the degree of occurrence of the failure of radio communication, and so on, for example. The speed $V_u$ of the dump truck 20 may be the present speed of the dump truck 20 measured from the rotation speed and the like of the wheel, that is, the detection value of the wheel speed sensor 282, and may use a maximum allowable speed that has been set in the map information stored in the master map information DB 316 and the terminal side map information DB 266 with respect to the present travel position of the dump truck 20.

When the travel permission remaining distance D of the dump truck 20 becomes equal to or less than the travel permission demand start distance Da, the dump truck 20 transmits the section demand information to the control server 31. The section demand information includes information of the present position of the dump truck 20.

When the section demand information is received from the dump truck 20-1, the travel permission section setting unit 311*b* determines a section (corresponding to the travel route 64 between neighboring nodes 65) where the dump truck 20-1 exists on the basis of the information of the present position included in the section demand information having been transmitted. Then, the travel permission section setting unit 311*b* grants a travel permission with respect to a section that becomes equal to or longer than the travel permission granted length from the distal end of the section where the dump truck 20-1 exists toward the front in the advancing direction of the dump truck 20-1. However, when there is a section where a permission has been granted to other vehicles, the travel permission section is granted with respect to a portion before it.

Figure 8B:
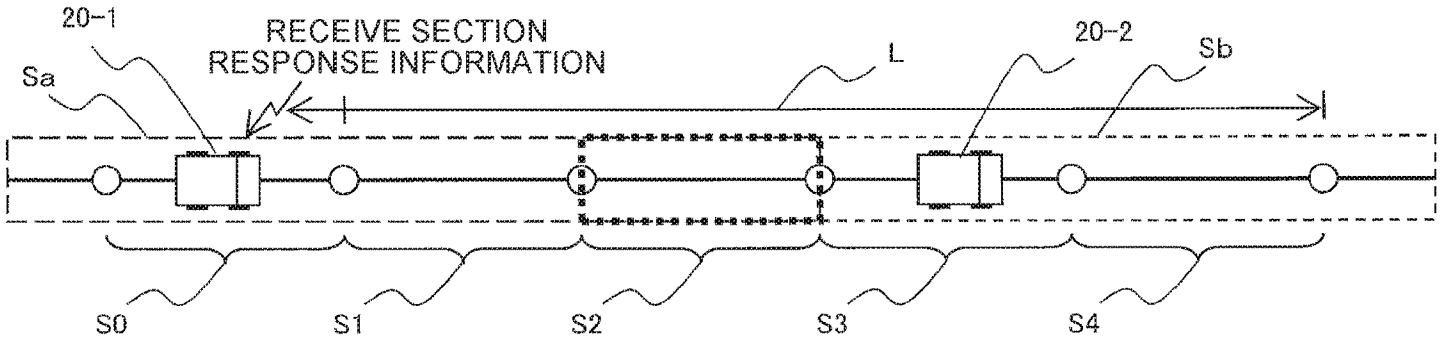
FIG. 8B is a drawing showing a travel permission section newly set for a dump truck to follow.

In the example shown in FIG. 8B, the section where the dump truck 20-1 exists is S0, and a section included in the travel permission granted length L from the distal end of it becomes sections S1, S2, S3, and S4. However, the sections S3 and S4 have been already granted to the dump truck 20-2 as the travel permission section Sb. Therefore, the candidate of the travel permission section that can be newly set for the dump truck 20-1 becomes the sections 51 and S2, however, the section 51 has been already included in the travel permission section Sa that has been set for the dump truck 20-1. Accordingly, the travel permission section setting unit 311*b* sets the section S2 only as a new travel permission section.

Figure 8C:
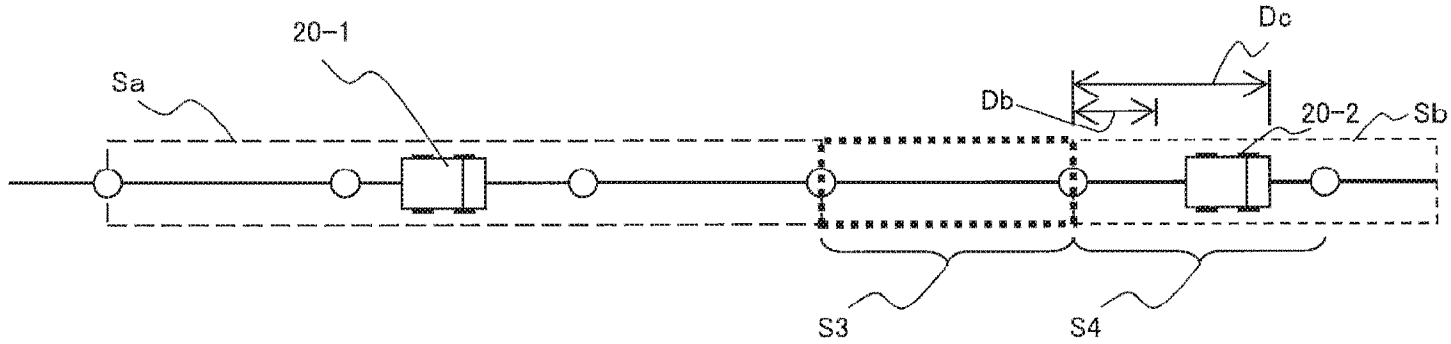
FIG. 8C is a drawing showing an open section.

The travel permission section setting unit 311*b* releases a section where the dump truck 20 has passed out of the sections where the travel permission has been granted at predetermined timing. In concrete terms, when a distance Dc from the distal end of the section S3 that becomes the releasing object to the position of the dump truck 20-2 becomes equal to or longer than a travel permission release distance Db determined beforehand as shown in FIG. 8C, the travel permission section setting unit 311*b* releases the section S3 from the travel permission section Sb. The section S3 having been released becomes capable of being set as the travel permission section Sa for the dump truck 20-1 following up.

Interference of the dump trucks 20-1 and 20-2 can be prevented by assigning the travel permission sections Sa and Sb as described above. Thus, when the vehicle traveling the travel route 64 is the dump truck 20-1 and 20-2 as an unmanned vehicle, unerring travel within the travel permission sections Sa, Sb becomes possible by the terminal side control device 26. However, when the vehicle is the manned vehicle 70, there is a possibility that the vehicle erroneously enters a travel permission section of other vehicles by overlooking of a display and an instruction by the driver and so on, and therefore the countermeasures for it are necessary.

Therefore, the terminal side control device 761 of the manned vehicle terminal device 76 related to the first embodiment of the present invention has a function as a travel instruction processing device that executes a process for instructing travel of the own vehicle to the driver on the basis of the travel permission section assigned by the control server 31. Also, for the driver of the manned vehicle 70, free travel is allowed basically as far as the manned vehicle 70 travels within the range of the travel permission section assigned to the own vehicle, however, it is required to surely stop within the travel permission section when the own vehicle approaches the distal end of the travel permission section. In this regard, although it is also conceivable to present the distance to the distal end of the travel permission section to the driver of the manned vehicle 70, in general, it is difficult for the driver to stop the own vehicle at a target position only from the numerical value of the distance compared with a case the driver stops the own vehicle while looking at a target object. Therefore, the first embodiment of the present invention shows an example of presenting an upper limit speed that becomes an indication for the driver to stop the own vehicle within a travel permission section.

Below, a concrete configuration showing the function of the manned vehicle terminal device 76 related to the first embodiment of the present invention will be explained in detail referring to FIG. 9 to FIG. 11.

Figure 9:
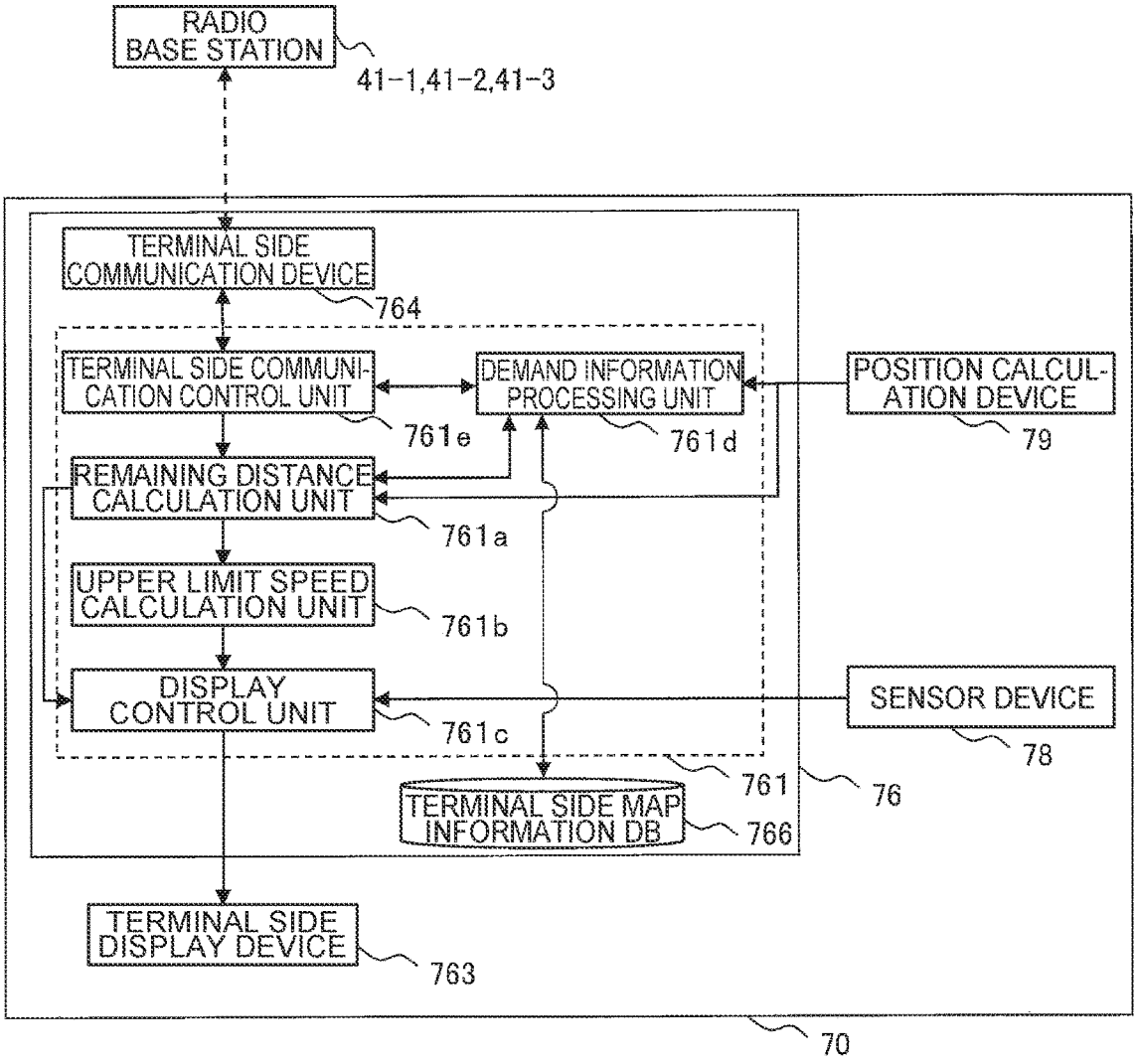
FIG. 9 is a function block diagram showing main functions of a manned vehicle terminal device shown in FIG. 6.
Figure 10:
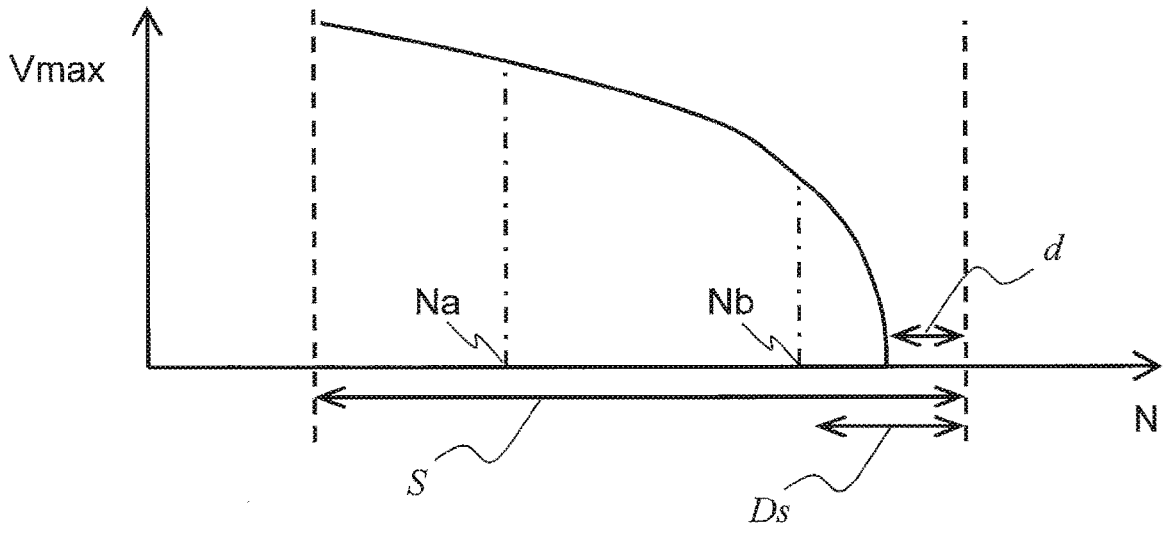
FIG. 10 is a drawing showing the relationship between a position N of a manned vehicle traveling a travel permission section S and an upper limit speed Vmax.

As shown in FIG. 9, the terminal side control device 761 includes a remaining distance calculation unit 761*a*, an upper limit speed calculation unit 761*b*, a display control unit 761*c*, a demand information processing unit 761*d*, and a terminal side communication control unit 761*e*. Since these demand information processing unit 761*d* and terminal side communication control unit 761*e* have a configuration similar to that of the dump terminal device 26, duplicated explanation thereof will be omitted. Also, the position information showing the present position of the own vehicle calculated by the position calculation device 79 that is mounted on the manned vehicle 70 is transmitted to the control server 31 through the terminal side communication control unit 761*e*. Also, when the manned vehicle 70 is the dump truck 71 where a driver gets on the dump truck 20 having been positioned as an unmanned vehicle, the terminal side control device 761*a* also includes the autonomous travel control unit 261*a* that is similar to the dump terminal device 26 in addition to the constituent elements described above.

The remaining distance calculation unit 761*a* calculates the travel permission remaining distance D on the basis of the present position of the own vehicle calculated by the position calculation device 79 that is connected to the terminal side control device 761*a* and the travel permission section assigned to the own vehicle by the control server 31.

The upper limit speed calculation unit 761*b* calculates the upper limit speed of the own vehicle in the travel permission section on the basis of the travel permission remaining distance D calculated by the remaining distance calculation unit 761*a*. In concrete terms, the upper limit speed calculation unit 761*b* calculates an upper limit speed $V_{max}$ as a speed at which the own vehicle travels from a present position N and can stop at a target position (will be hereinafter referred to as "stop target position" for convenience) before the distal end of a travel permission section S by a predetermined margin distance d as shown in FIG. 10, for example. This upper limit speed $V_{max}$ can be obtained using an expression (3) below.

[Math. 3]

$$V_{max} = \sqrt{\frac{2f_h(D-d)}{M_h}} \tag{1}$$

where $f_h$: braking force of manned vehicle $M_h$: mass of manned vehicle including load Accordingly, when the margin distance d is set to the value of 0 beforehand, the upper limit speed $V_{max}$ can be obtained as a speed stoppable at the distal end of the travel permission section S. Also, the upper limit speed calculation unit 761*b* may calculate the upper limit speed $V_{max}$ taking a parameter affecting the braking distance of the own vehicle into account. As such parameter, the inclination of the travel route 64 of the upward slope, downward slope and the like, easiness of sliding of the road surface, and so on can be cited, for example. The inclination of the travel route 64 can be calculated on the basis of the height information of the travel route 64 acquired from the map information, and easiness of sliding of the road surface can be calculated on the basis of information of the climate and a road surface state inputted by a driver using the terminal side input device 762. Also, the braking force $f_h$ of the manned vehicle 70 may be one that is on the basis of a braking force by the regenerative brake 771, for example. Thus, in calculation of the upper limit speed $V_{max}$ of the own vehicle by the upper limit speed calculation unit 761*b*, a calculation result of the upper limit speed $V_{max}$ with high accuracy can be obtained by considering a parameter that affects the braking distance of the own vehicle.

The display control unit 761*c* functions as an information presentation unit that makes the terminal side display device 763 connected to the terminal side control device 761 output the upper limit speed $V_{max}$ calculated by the upper limit speed calculation unit 761*b* and predetermined warning information corresponding to the upper limit speed $V_{max}$ and presents the same to the driver.

Next, a process of display control for the upper limit speed $V_{max}$ and the warning information to the terminal side display device 763*b* by the display control unit 761*c* will be explained in detail referring to FIG. 11.

Figure 11A:
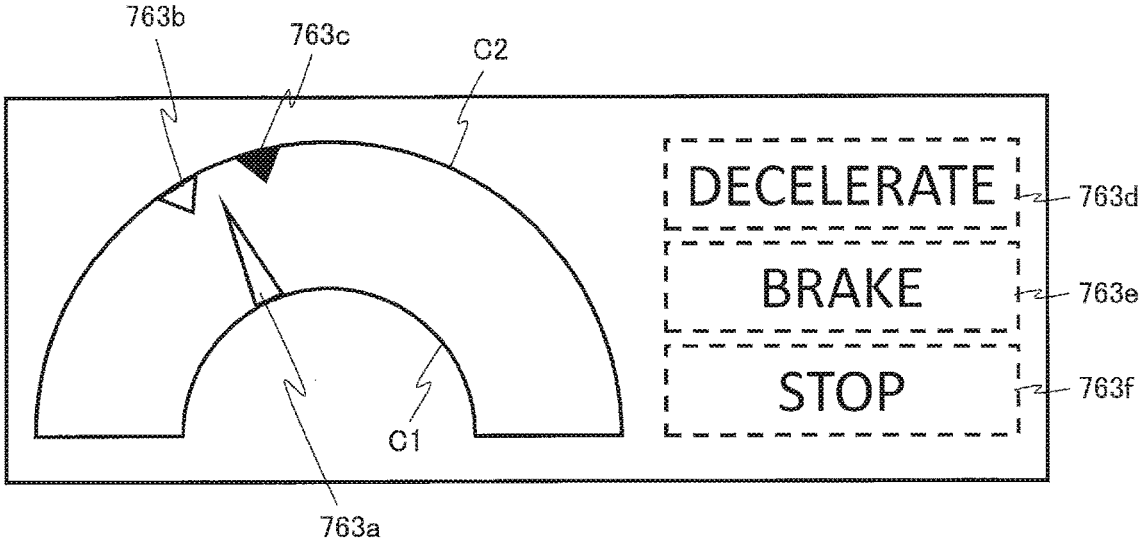
FIG. 11A is a drawing showing a display example when a manned vehicle travels at a position Na of FIG. 10.
Figure 11B:
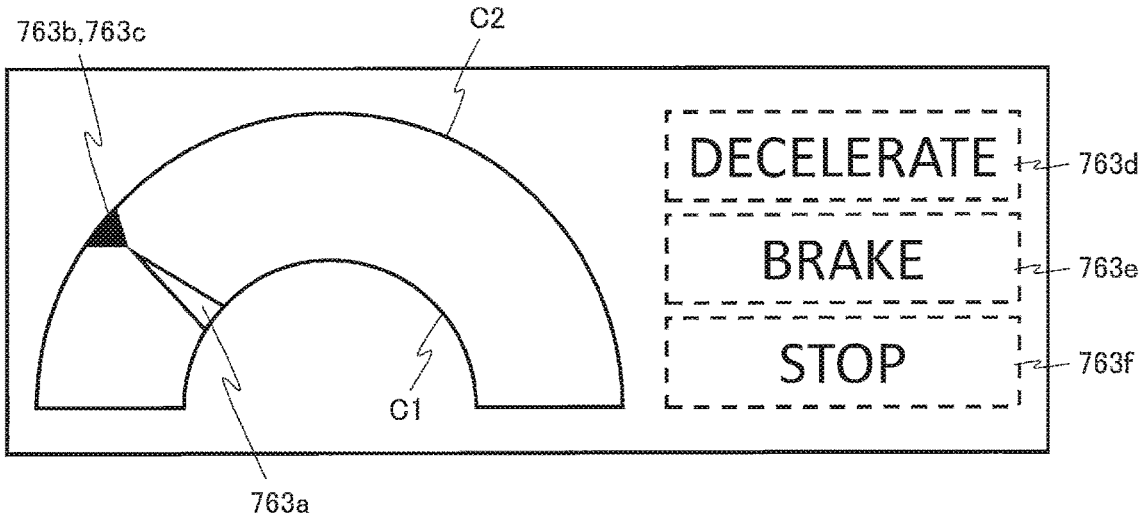
FIG. 11B is a drawing showing a display example when the manned vehicle travels at a position Nb of FIG. 10.

As shown in FIG. 11A, 11B, on a display screen of the terminal side display device 763 with respect to the upper limit speed $V_{max}$, there are projected a present speed indicator 763*a* that shows the present speed of the own vehicle, a proper speed indicator 763*b* that shows a speed suitable for the own vehicle to travel within the travel permission section S, that is, a proper speed, and an upper speed indicator 763*c* that shows the upper limit speed $V_{max}$ with respect to the present position N of the own vehicle in the travel permission section S. In the first embodiment of the present invention, the present speed indicator 763*a* is formed into a long needle shape, and moves along an arc C1 of a semicircular shape of the inner side. The proper speed indicator 763*b* is formed into a white short needle shape, the upper speed indicator 763*c* is formed into a black short needle shape, and these proper speed indicator 763*b* and upper speed indicator 763*c* move along an arc C2 of a semicircular shape of the outer side. Also, on the display screen of the terminal side display device 763 with respect to the upper limit speed $V_{max}$, scale marks may be provided which allow the driver to grasp a speed corresponding to a position pointed by the respective indicators 763*a* to 763*c* as a numerical value.

On a display screen of the terminal side display device 763 with respect to the warning information, there are projected a DECELERATE light 763*d* for urging the driver to decelerate when the speed of the own vehicle approaches the upper limit speed $V_{max}$, a BRAKE light 763*e* for urging the driver to positively decelerate using a braking means such as the mechanical brake 772 when the speed of the own vehicle exceeds the upper limit speed $V_{max}$, and a STOP light 763*f* for urging the driver to stop the own vehicle and continue a stand-by state when the own vehicle approaches the distal end of the travel permission section S and new travel permission section S has not been obtained.

The display control unit 761*c* executes control for turning the present speed indicator 763*a* clockwise when the speed of the own vehicle detected by the wheel speed sensor 782 increases as shown in FIG. 11A, and for turning the present speed indicator 763*a* counterclockwise when the speed of the own vehicle detected by the wheel speed sensor 782 lowers as shown in FIG. 11B. Also, the display control unit 761*c* executes control for using the maximum allowable speed of the travel permission section S, for example, as a proper speed of the own vehicle, and turning the proper speed indicator 763*b* to a position corresponding to this maximum allowable speed.

Further, the display control unit 761*c* executes control for turning the upper speed indicator 763*c* clockwise when the upper limit speed $V_{max}$ calculated by the upper speed calculation unit 761*b* increases as shown in FIG. 11A, and for turning the upper speed indicator 763*c* counterclockwise when the upper limit speed $V_{max}$ calculated by the upper speed calculation unit 761*b* lowers as shown in FIG. 11B. Also, when the upper limit speed $V_{max}$ calculated by the upper speed calculation unit 761*b* lowers further, because the proper speed of the own vehicle agrees to the upper limit speed $V_{max}$, the proper speed indicator 763*b* and the upper speed indicator 763*c* turn counterclockwise together while overlapping to each other accompanying drop of the upper limit speed $V_{max}$.

The display control unit 761*c* executes control for turning on the DECELERATE light 763*d* when the speed of the own vehicle detected by the wheel speed sensor 782 is equal to or higher than a predetermined warning speed Va, and for turning off the DECELERATE light 763*d* when the speed of the own vehicle detected by the wheel speed sensor 782 is lower than the warning speed Va. Said warning speed Va is set, for example, to a value obtained by deducting a predetermined margin speed Vm from the upper limit speed $V_{max}$ ($Va=V_{max}-Vm$).

The display control unit 761*c* executes control for turning on the BRAKE light 763*e* when the speed of the own vehicle detected by the wheel speed sensor 782 is equal to or higher than the upper limit speed $V_{max}$ and for turning off the BRAKE light 763*e* when the speed of the own vehicle detected by the wheel speed sensor 782 is lower than the upper limit speed $V_{max}$.

Also, the display control unit 761*c* executes control for turning on the STOP light 763*f* when the travel permission remaining distance D calculated by the remaining distance calculation unit 761*a* is equal to or less than a predetermined threshold value Ds (refer to FIG. 10), and for turning off the STOP light 763*f* when the travel permission remaining distance D calculated by the remaining distance calculation unit 761*a* is greater than the threshold value Ds. In other words, the display control unit 761*c* presents stop information urging stop of the own vehicle by turning on the STOP light 763*f*. Said threshold value Ds is determined beforehand to a distance from the distal end of the travel permission section S to a position set to be front of the target stop position (will be hereinafter referred to as "target arrival determination distance" for convenience) as shown in FIG. 10, for example, and the manned vehicle 70 comes to have reached the vicinity of the target stop position at the time point the travel permission remaining distance D has become equal to or shorter than this target arrival determination distance Ds.

The remaining distance calculation unit 761*a*, the upper limit speed calculation unit 761*b*, the display control unit 761*c*, the demand information processing unit 761*d*, and the terminal side communication control unit 761*e* included in the manned vehicle terminal device 76 configured thus are achieved by that the programs achieving the functions of them are executed by the terminal side control device 761 (hardware) shown in FIG. 6.

Figure 12:
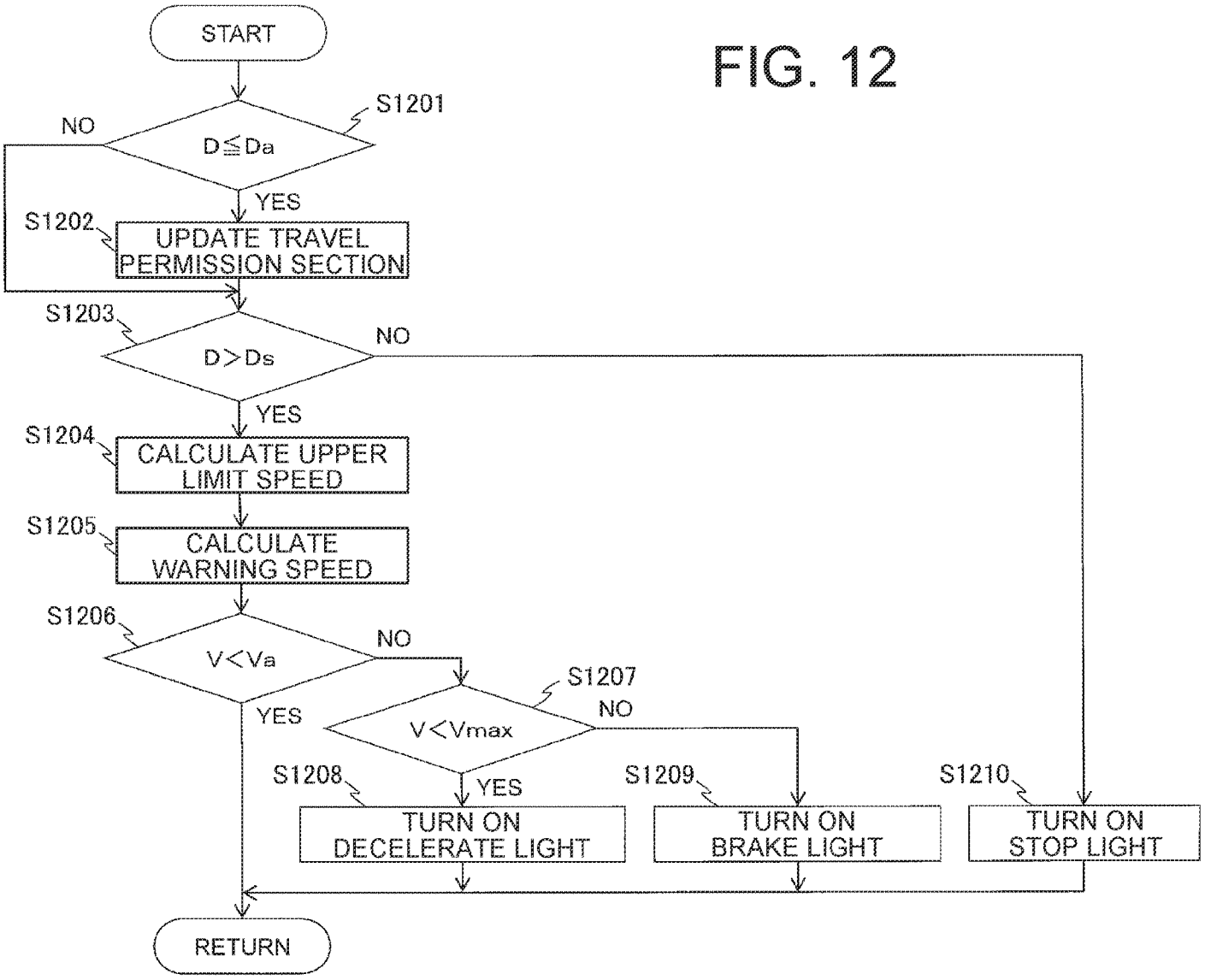
FIG. 12 is a flowchart showing a flow of processing motions of a manned vehicle terminal device related to the first embodiment of the present invention.

Next, the processing motions of the manned vehicle terminal device 76 related to the first embodiment of the present invention will be explained in detail on the basis of a flowchart of FIG. 12.

First, the demand information processing unit 761*d* of the terminal side control device 761 in the manned vehicle terminal device 76 inputs the calculation result of the remaining distance calculation unit 761*a* of the terminal side control device 761, and determines whether the travel permission remaining distance D calculated by the remaining distance calculation unit 761*a* is equal to or shorter than the travel permission demand start distance Da (step (will be hereinafter written as "S") 1201). At this time, when it is determined that the travel permission remaining distance D is longer than the travel permission demand start distance Da (S1201/NO), the demand information processing unit 761*d* does not update the travel permission, and proceeds to the process S1203 described below.

In S1201, when it is determined that the travel permission remaining distance D is equal to or shorter than the travel permission demand start distance Da (S1201/YES), the demand information processing unit 761*d* transmits the section demand information to the control server 31 through the terminal side communication control unit 761*e* and the terminal side communication device 764, and new travel permission section S is thereby obtained from the control server 31 for updating (S1202).

Next, the upper limit speed calculation unit 761*b* of the terminal side control device 761 inputs the calculation result of the remaining distance calculation unit 761*a*, and determines whether the travel permission remaining distance D calculated by the remaining distance calculation unit 761*a* is longer than the target arrival determination distance Ds (S1203). At this time, when it is determined that the travel permission remaining distance D is longer than the target arrival determination distance Ds (S1203/YES), the upper limit speed calculation unit 761*b* calculates the upper limit speed $V_{max}$ of the own vehicle in the travel permission section S on the basis of the travel permission remaining distance D (S1204), and the calculation result thereof is outputted to the display control unit 761*c* of the terminal side control device 761.

Next, the display control unit 761*c* inputs the calculation result of the upper limit speed calculation unit 761*b*, deducts the margin speed Vm from the upper limit speed $V_{max}$ calculated by the upper limit speed calculation unit 761*b*, and calculates the warning speed Va (S1205). Also, the display control unit 761*c* inputs the detection result of the wheel speed sensor 782, and determines whether a speed V of the own vehicle detected by the wheel speed sensor 782 is less than the warning speed Va (S1206). At this time, when it is determined that the speed V of the own vehicle is less than the warning speed Va (S1206/YES), the display control unit 761*c* turns off the DECELERATE light 763*d*, the BRAKE light 763*e*, and the STOP light 763*f*, and the process from S1201 is thereafter repeated.

On the other hand, when it is determined that the speed V of the own vehicle is equal to or higher than the warning speed Va in S1206 (S1206/NO), the display control unit 761*c* determines whether the speed V of the own vehicle is lower than the upper limit speed $V_{max}$ (S1207). At this time, when it is determined that the speed V of the own vehicle is lower than the upper limit speed $V_{max}$ (S1207/YES), the display control unit 761*c* turns on the DECELERATE light 763*d* (S1208), and the process from S1201 is repeated. Thereby, the driver of the manned vehicle 70 confirms the display screen of the terminal side display device 763, accelerates or decelerates the own vehicle according to presence/absence of turning on of the DECELERATE light 763*d*, and can thereby stop the own vehicle without running off the inside of the travel permission section S.

When it is determined that the speed V of the own vehicle is equal to or higher than the upper limit speed $V_{max}$ in S1207, (S1207/NO), the display control unit 761*c* turns on the BRAKE light 763*e* (S1209), and the process from S1201 is repeated. Also, when it is determined that the travel permission remaining distance D is equal to or shorter than the target arrival determination distance Ds in S1203 (S1203/NO), the upper limit speed calculation unit 761*b* turns on the STOP light 763*f* (S1210), and the process from S1201 is repeated.

Therefore, when the driver of the manned vehicle 70 stops the own vehicle at a position extremely before the distal end of the travel permission section S, because the STOP light 763*f* has been turned off, the driver accelerates or decelerates the own vehicle while confirming the respective indicators 763*a* to 763*c* projected on the display screen of the terminal side display device 763, and thereby can make the own vehicle travel efficiently within the travel permission section S. Also, the driver stops the own vehicle at a time point the STOP light 763*f* is turned on, and the own vehicle can thereby stand by at a proper position until new travel permission section S is obtained. Further, when the own vehicle obtains new travel permission section S, the STOP light 763*f* is turned off again, and therefore the driver can start travel of the own vehicle smoothly.

According to the traffic control system 1 and the manned vehicle terminal device 76 related to the first embodiment of the present invention configured thus, the process of instructing travel of the own vehicle to the driver after acquiring the new travel permission section S from the control server 31 is executed by the manned vehicle terminal device 76. Therefore, even when a problem occurs in the communication communication condition such as interruption of communication between the dump truck 20, the manned vehicle 70 and the control server 31, and so on, by confirming each of the indicators 763*a* to 763*c* and the lights 763*d* to 763*f* of the display screen of the terminal side display device 763, the driver of the manned vehicle 70 can make the own vehicle travel stably to the end of the travel permission section S. Thus, even when a problem occurs in the communication condition, interference of the dump truck 20 and the manned vehicle 70 can be suppressed, and the working efficiency can be improved.

Also, in the first embodiment of the present invention, the upper limit speed $V_{max}$ indicated by the upper limit speed indicator 763*c* projected on the display screen of the terminal side display device 763 shows a speed at which the own vehicle travels from the present position N and can stop at a target stop position before the distal end of the travel permission section S by the margin distance d, and therefore the driver can prevent the own vehicle from running off the inside of the travel permission section S by adjusting the speed of the own vehicle so that the present speed indicator 763*a* does not exceed the upper limit speed indicator 763*c*.

Second Embodiment

Figure 13:
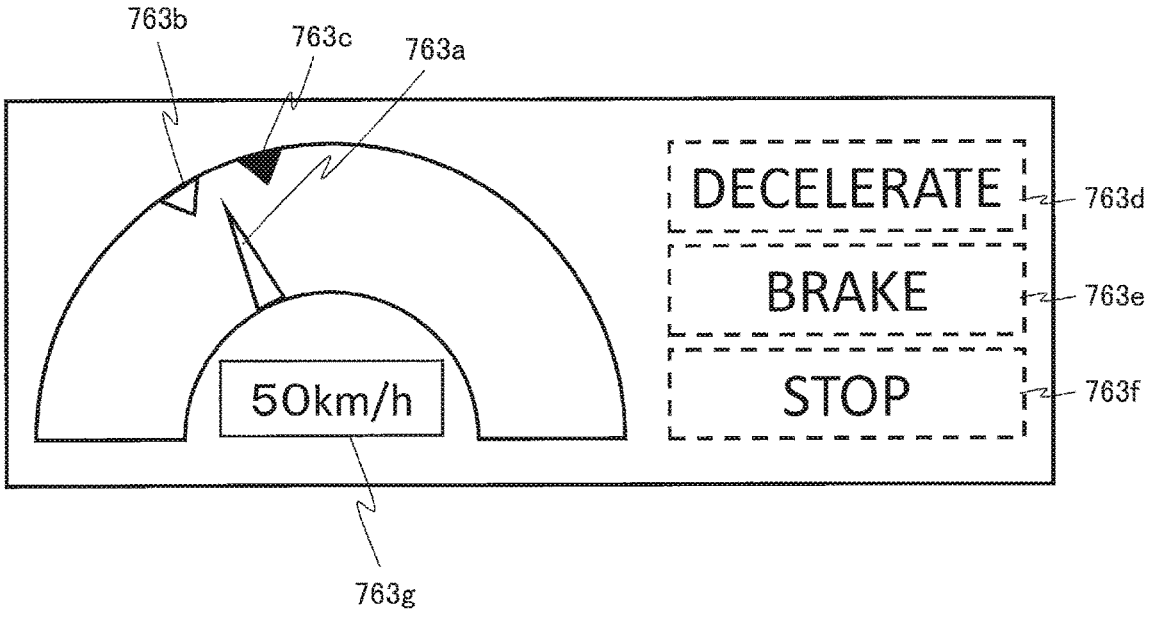
FIG. 13 is a drawing showing a configuration of a display screen of a terminal side display device related to a second embodiment of the present invention.
Figure 14:
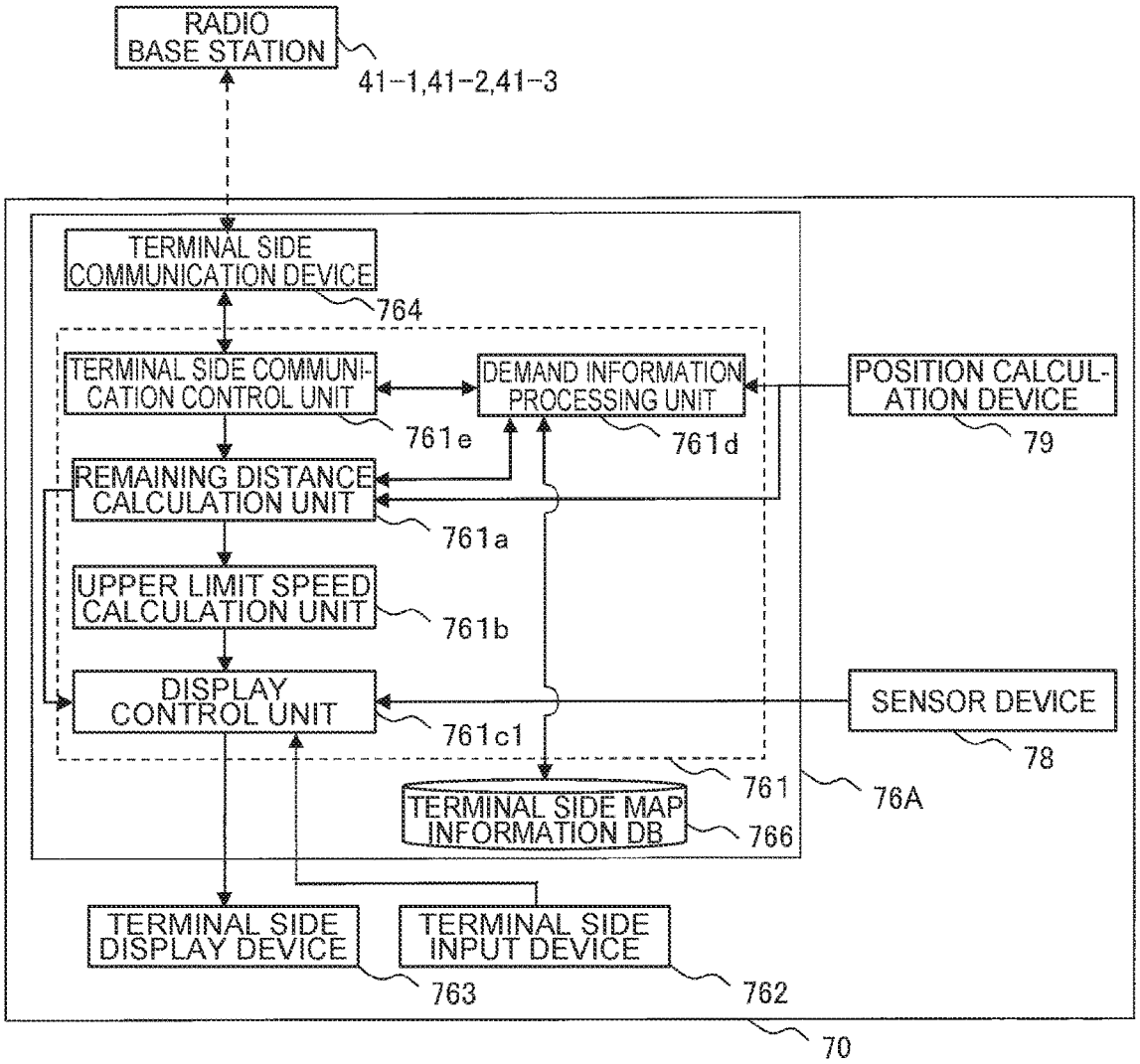
FIG. 14 is a function block diagram showing main functions of a manned vehicle terminal device related to the second embodiment of the present invention.

Next, the configuration of a manned vehicle terminal device 76A related to a second embodiment of the present invention will be explained in detail referring to FIG. 13 and FIG. 14.

In the manned vehicle terminal device 76A related to the second embodiment of the present invention, in addition to the configuration of the first embodiment described above, as shown in FIG. 13, a speed display part 763*g* that displays a speed by a numerical value is projected on the display screen of the terminal side display device 763 with respect to the upper limit speed $V_{max}$, the speed being shown by at least one of the present speed indicator 763*a*, the proper speed indicator 763*b*, and the upper speed indicator 763*c*.

In this case, a display control unit 761*c*1 related to the second embodiment of the present invention executes control of switching display of the speed display part 763*g* to a speed selected by the driver of the manned vehicle 70 out of the present speed, the proper speed, and the upper limit speed $V_{max}$ of the own vehicle according to operation of the terminal side input device 762 by the driver. Also, in an example shown in FIG. 13, the upper limit speed $V_{max}$ is displayed to be 50 km/h in the speed display part 763*g*. Other configurations of the second embodiment are same to those of the first embodiment, a portion duplicating with or corresponding to that of the first embodiment is marked with a same reference sign, and duplicated explanation thereof is omitted.

According to the manned vehicle terminal device 76A related to the second embodiment of the present invention, in addition to that actions and effects similar to those of the first embodiment described above are obtained, the driver of the manned vehicle 70 not only can sensuously grasp information on the speed of the own vehicle from the respective indicators 763*a* to 763*c* on the display screen of the terminal side display device 763, but also can precisely grasp information of the speed selected using the terminal side input device 762 from the speed display part 763*g* on the display screen of the terminal side display device 763. Thus, travel of the own vehicle with high accuracy by a driver can be achieved.

Also, the present embodiments described above have been explained in detail for easy understanding of the present invention, and are not necessarily limited to those including all configurations explained. Furthermore, a part of a configuration of a certain embodiment can be replaced by a configuration of other embodiments, and a configuration of other embodiments can be also added to a configuration of a certain embodiment.

Also, in the present embodiments, when a number and the like (inclusive of number of pieces, numerical value, volume, range, and the like) of an element is mentioned, the number and the like of the element is not limited to the specific number but may be equal to and more than and equal to and less than the specific number excluding a case specifically stated and a case apparently limited to a specific number in principle, and so on. In addition, a constituent element (inclusive of a processing motion and the like) included in the present embodiments is not necessarily indispensable but may possibly be omitted properly excluding a case specifically stated and a case considered to be apparently indispensable in principle, and so on.

Furthermore, although the manned vehicle terminal devices 76, 76A related to the present embodiments were explained with respect to the case the upper limit speed $V_{max}$ of the own vehicle and the warning information were presented to the driver using the respective indicators 763*a* to 763*c* and the respective lights 763*d* to 763*f* projected on the display screen of the terminal side display device 763, the manned vehicle terminal devices 76, 76A are not limited to this case, and it is also possible that a voice capable of discriminatingly grasping these upper limit speed $V_{max}$ and warning information is outputted, or that such voice and the respective indicators 763*a* to 763*c* and lights 763*d* to 763*f* are combined.

LIST OF REFERENCE SIGNS

1 . . . traffic control system, 20, 20-1, 20-2 . . . dump truck (unmanned vehicle), 30 . . . control center, 31 . . . control server (traffic control server), 40 . . . radio communication channel, 50-1, 50-2, 50-3 navigation satellite (position acquiring device), 64 . . . travel route, 70 . . . manned vehicle, 71 . . . dump truck, 72 . . . service car, 76, 76A . . . manned vehicle terminal device (onboard terminal device), 77 . . . vehicle control device, 78 . . . sensor device, 79 . . . position calculation device (position acquiring device), 311 . . . server side control device, 311*a* . . . vehicle dispatch managing unit, 311*b* . . . travel permission section setting unit, 311*c* . . . travel control unit, 311*d* . . . server side communication control unit, 761 . . . terminal side control device (travel instruction processing device), 761*a* . . . remaining distance calculation unit, 761*b* . . . upper limit speed calculation unit, 761*c*, 761*c*1 . . . display control unit (information presentation unit), 761*d* . . . demand information processing unit, 761*e* . . . terminal side communication control unit, 762 . . . terminal side input device, 763 . . . terminal side display device (output device), 763*a* . . . present speed indicator, 763*b* . . . proper speed indicator, 763*c* . . . upper limit speed indicator, 763*d* . . . DECELERATE light, 763*e* . . . BRAKE light, 763*f* . . . STOP light, 763*g* . . . speed indication part, 764 . . . terminal side communication device, 765 . . . communication bus, 766 . . . terminal side map information DB, 771 . . . regenerative brake, 772 . . . mechanical brake, 773 . . . steering control device, 774 . . . acceleration control device, 781 . . . environmental sensor, 782 . . . wheel speed sensor

The invention claimed is:

1. An onboard terminal device that is connected to a traffic control server through a radio communication channel, the traffic control server conducting traffic control for avoiding interference between vehicles including a manned vehicle and an unmanned vehicle that travels autonomously in a mine, and the onboard terminal device is mounted on the manned vehicle operated by a driver, comprising:

a travel instruction processing device that is configured to conduct processing for instructing the driver on travel of the manned vehicle based on a travel permission section where a partial section of a travel route of the vehicle is assigned by the traffic control server as a section permitted for the manned vehicle to travel, wherein the travel instruction processing device is further configured to:

calculate a travel permission remaining distance between a present position of the manned vehicle to an end of the travel permission section along the travel route on the basis of the travel permission section and the present position of the manned vehicle which is acquired from a position acquiring device that is connected to the travel instruction processing device;

calculate an upper limit speed of the manned vehicle in the travel permission section on the basis of the travel permission remaining distance; and cause an output device connected to the travel instruction processing device to output and present to the driver a speed display area and a warning information display area which is displayed side by side with the speed display area, wherein a first marker indicating a predefined allowable speed in the travel permission section, a second marker indicating the upper limit speed, and a pointer indicating a current speed of the manned vehicle are displayed in the speed display area, wherein the marker indicating the allowable speed and the marker indicating the upper limit speed are arranged on a same circumference of the speed display area and move independently along the circumference, and wherein predetermined warning information corresponding to the upper limit speed is displayed in the warning information display area.

2. The onboard terminal device according to claim 1, wherein stop information is displayed in the warning information display area to urge the manned vehicle to stop when the travel permission remaining distance is equal to or less than a predetermined threshold value.

3. The onboard terminal device according to claim 1, wherein the upper limit speed is calculated as a speed at which the manned vehicle travels from the present position and can stop at a target position before the end of the travel permission section by a predetermined distance.

4. The onboard terminal device according to claim 1, wherein the upper limit speed is calculated based on a parameter that affects a braking distance of the manned vehicle.

5. A traffic control system, comprising:

a traffic control server configured to conduct traffic control for avoiding interference between vehicles including a manned vehicle operated by a driver and an unmanned vehicle that travels autonomously in a mine; and an onboard terminal device that is connected to the traffic control server through a radio communication channel and is mounted on the manned vehicle wherein the traffic control server is further configured to set a partial section of a travel route of the manned vehicle as a travel permission section permitted for the manned vehicle to travel, wherein the onboard terminal device comprises a travel instruction processing device that is configured to conduct processing for instructing the driver on travel of the manned vehicle based on the travel permission section, and wherein the travel instruction processing device is further configured to:

calculate a travel permission remaining distance between a present position of the manned vehicle to an end of the travel permission section along the travel route on the basis of the present position of the manned vehicle acquired from a position acquiring device that is connected to the travel instruction processing device and the travel permission section;

calculate an upper limit speed of the manned vehicle in the travel permission section on the basis of the travel permission remaining distance; and cause an output device connected to the travel instruction processing device to output and present to the driver a speed display area and a warning information display area which is displayed side by side with the speed display area, wherein a first marker indicating a predefined allowable speed in the travel permission section, a second marker indicating the upper limit speed, and a pointer indicating a current speed of the manned vehicle are displayed in the speed display area, wherein the marker indicating the allowable speed and the marker indicating the upper limit speed are arranged on a same circumference of the speed display area and move independently along the circumference, and wherein predetermined warning information corresponding to the upper limit speed is displayed in the warning information display area.

6. The onboard terminal device according to claim 1, wherein a pointed tip of the pointer indicating the current speed moves on a movement path of a pointed tip of the first marker indicating the allowable speed and a pointed tip of the second marker indicating the upper limit speed.

7. The onboard terminal device according to claim 1, wherein deceleration information is displayed in the warning information display area to urge the manned vehicle to decelerate when the current speed of the manned vehicle approaches or exceeds the upper limit speed, and stop information is displayed in the warning information display area to urge the manned vehicle to stop when the manned vehicle approaches the end of the travel permission section.

* * * * *